United States Patent [19]

Speicher

[11] 4,036,127

[45] July 19, 1977

[54] PLATE MARKING APPARATUS

[75] Inventor: Edwin W. Speicher, Pittsburgh, Pa.

[73] Assignee: M. E. Cunningham Company, Ingomar, Pa.

[21] Appl. No.: 625,059

[22] Filed: Oct. 23, 1975

[51] Int. Cl.[2] ..... B41F 17/00

[52] U.S. Cl. ..... 101/5; 101/22; 101/35; 101/245

[58] Field of Search ..... 101/4, 5, 6, 22, 23, 101/35, 36, 37, 235, 245

[56] References Cited

U.S. PATENT DOCUMENTS

| | | | |
|---|---|---|---|
| 1,596,416 | 8/1926 | Ericson | 101/31 |
| 2,447,015 | 8/1948 | Jacobs et al. | 101/6 X |
| 2,562,627 | 7/1951 | McKay | 101/37 X |
| 2,636,436 | 4/1953 | Mann | 101/35 X |
| 2,871,781 | 2/1959 | Schempp | 101/235 |
| 2,913,978 | 11/1959 | Lane | 101/4 |
| 2,994,264 | 8/1961 | Hauer | 101/4 X |
| 3,072,052 | 1/1963 | Bach | 101/235 |
| 3,162,118 | 12/1964 | Martensson et al. | 101/245 X |
| 3,735,697 | 5/1973 | Provan | 101/37 |

*Primary Examiner*—Edward M. Coven
*Attorney, Agent, or Firm*—Stanley J. Price, Jr.; John M. Adams

[57] ABSTRACT

A vertical cylindrical member is supported by a frame adjacent a plurality of rotatable horizontally mounted rollers that support a plate to be marked. A carriage is mounted for vertical reciprocal movement on the cylindrical member. A piston cylinder assembly having an extensible piston rod positioned therein is secured at one end to the upper portion of the cylindrical member. The end of the piston rod is connected to the carriage. A shaft is rotatably supported by and positioned below the carriage. A marking wheel having a plurality of marking elements retained on the surface thereof is secured to the end of the shaft in overlying relation with the surface of the plate to be marked. The piston cylinder assembly maintains a preselected marking pressure on the marking wheel of the plate to be marked. A prime mover is mounted on the carriage and is drivingly connected by a single revolution clutch to the shaft to rotate the marking wheel and urge the marking elements into marking engagement with the surface of the plate to mark the plate. After each actuation of the clutch the marking wheel is returned to position the marking elements relative to the surface of the plate so that the plate may pass unobstructed beneath the marking wheel. Actuation of the clutch effects single rotation of the marking wheel and marking engagement of each of the marking elements with the surface of the plate to impress a preselected marking arrangement on the surface of the plate. A second piston cylinder assembly is connected to the carriage and the frame and is operable to laterally pivot the carriage through an angle of 90° to move the marking wheel into and out of marking position relative to the plate to facilitate a change of marking elements on the marking wheel or marking wheels on the shaft.

8 Claims, 7 Drawing Figures

3
18
36
12
38
38
22
24
74
80
16
94
78
28
92
90
96
98
100
26
82
34
3
33
41
41
39
13
72
32

32
36
4
5
5
39
13
24
74
100
4
92
26
98
78
72
12
30
90
96
82
20
16
28
10
22
31
72
34
84
86
88
14
24
72
32

PLATE MARKING APPARATUS

BACKGROUND OF THE INVENTION

1. Field of the Invention

This invention relates to a marking apparatus and more particularly to apparatus that supports marking elements for vertical and lateral movement into and out of marking position with respect to the surface of a plate member to be marked.

2. Description of the Prior Art

Conventional plate marking and stamping machines impress identification marks on the surface of plates, slabs, billets and the like as they travel on a roller table during the production process for the purpose of identifying the plate by the impression made. The stamps or marking elements impact the surface of the plate as it advances on the roller table in marking relationship with the stamp or marking elements. In this manner a continuous marking process is accomplished as the plate in the production process is transferred from station to station without requiring separate handling of the plate for marking purposes.

As the roller table advances the plate into marking position with respect to the stamping machine, the marking stamp or heads are urged by a power means to strike the surface of the plate with sufficient force and velocity to impress a mark on the plate. The stamp is returned by the marking means to its original position. A problem is created by the need to replace the stamps or marking elements in the support member requiring interruption of the plate feeding on the roller table. Furthermore, substantial production time is lost in the interchange of the marking elements on the marking head.

One method of changing stamps in marking slabs is disclosed in U.S. Pat. No. 2,690,116 wherein a group of stamps are retained by a stamp retaining member. A hammer is provided for each stamp and by actuating a pneumatic piston cylinder assembly the selected hammer is swung down to strike the corresponding stamp retained by the stamp retaining member. The piston cylinder assembly is also operable to provide for simultaneous release of all the hammers so that the slab is marked by all of the stamps. To change a stamp in the stamp retaining member the stamp releasing member is manually raised for removal of the stamp and insertion of a new stamp in the vacant slot. With this arrangement, if a single stamp is to be impressed upon the slab, the position of the impression is limited to the position of the respective stamp in the stamp retaining member relative to the surface of the slab. Furthermore, the arrangement of the stamps made on the slab is determined by the arrangement of the stamps in the retaining member and the position of the stamp retaining member relative to the surface of the slab.

In U.S. Pat. No. 3,020,834 a changeable stamping head is disclosed as being mounted by a carrying frame and moved between a stamping position and an indexing position displaced from the stamping area for setting the stamping dies in a selected position for the next stamping operation. Consequently, with this arrangement, to facilitate a change of dies in the stamping head, the stamping head must be removed from stamping relation with the surface of the object to be marked.

There is need for an apparatus for the marking and stamping of plates supported on a roller table which permits selective positioning of marking elements relative to the surface of the plate when the marking element holder is positioned to strike the surface of the plate. While it has been suggested to provide for changeable marking elements in the marking element holder, the prior art systems require moving the marking element holder from marking position with respect to the plate or manually removing the stamps from a stamp holder and replacing them with new stamps.

SUMMARY OF THE INVENTION

In accordance with the present invention there is provided apparatus for impressing a preselected mark on the surface of an object to be marked that includes a frame and a support member secured to the frame. A carriage is mounted for movement on the support member. A marking device supports a plurality of marking elements to impress a preselected mark on the surface of the object to be marked, and is rotatably supported on the carriage. A pressure mechanism is connected to the carriage and is operable to maintain a preselected marking force upon said marking device such that the object to be marked passes beneath the marking device. A piston cylinder assembly is secured to the support member and the carriage and is operable upon actuation to laterally move the marking device into and out of marking position to facilitate a change of marking elements thereon. A prime mover is mounted on the carriage and is drivingly connected to the marking device through a single revolution to urge the marking elements into marking engagement with the surface of the object to be marked to impress preselected marks thereon.

The support member includes a vertical cylindrical member having upper and lower end portions rigidly secured to the frame. The carriage is mounted on the cylindrical member for vertical movement relative to the surface of the object to be marked. The pressure mechanism includes a piston cylinder assembly that is rigidly secured at one end portion to the cylindrical member above the carriage and at the other end portion to the carriage. With this arrangement the piston cylinder assembly is operable to exert a preselected marking force on the marking device to maintain the marking device in marking position spaced from the surface of the object to be marked. The object may then pass unobstructed beneath the marking device between markings of the object. The clearance provided is adjustable to compensate for variations in the thickness of the object.

The piston cylinder assembly for laterally pivoting the carriage on the support member includes a cylinder with an end portion pivotally connected to the frame. An extensible piston rod having an end portion connected to the carriage extends and retracts the piston rod to laterally swing the carriage together with the marking apparatus in a horizontal plane into and out of marking position relative to the surface of the object to be marked. In this manner the marking apparatus may be displaced 90° from marking position to permit the marking elements on the marking device to be changed without removing the marking device from the carriage.

The marking device includes a marking wheel that is secured to the end of a shaft that is rotatably supported and positioned in underlying relation with the carriage. The pressure mechanism maintains the marking wheel in overlying marking position with the surface of the object to be marked so that the object may pass unobstructed beneath the marking wheel. The marking wheel includes a plurality of marking elements retained on the cylindrical surface of the marking wheel. The prime mover is connected to the opposite end of the shaft and is operable to rotate the shaft through a single revolution clutch to advance the marking elements of the marking wheel into marking engagement with the surface of the object as it travels below the marking wheel to impress a preselected marking pattern on the object. A sector of the surface of the marking wheel has a reduced circumference forming planar surfaces on the marking wheel. The planar surfaces provide clearance between the object and the marking wheel for the unobstructed passage of the object beneath the marking wheel when moved into marking position with the object.

Accordingly, the principal object of the present invention is to provide apparatus for impressing a mark upon a plate that is horizontally positioned to travel in underlying relation with a marking device that is mounted for rotation on a frame to impress a mark or stamp upon the surface of the plate member as it passes beneath the marking device.

Another object of the present invention is to provide a marking apparatus that is mounted on a support for lateral swinging movement into and out of marking position to facilitate change of marking elements on the marking device.

Another object of the present invention is to provide a marking apparatus for impressing preselected marks upon the surface of a plate member that is horizontally mounted relative to the apparatus and travels in underlying relation with the marking elements supported by the apparatus so that preselected marks may be stamped at preselected locations on the surface of the plate member.

A further object of the present invention is to provide a marking apparatus for impressing a mark on the surface of a horizontally positioned plate member and includes a marking wheel rotatably supported on a carriage to permit marking engagement of all the marking elements retained on the surface of the marking wheel with the surface of the plate upon a single rotation of the marking wheel.

These and other objects and advantages of the present invention will be more completely disclosed in the following specification, accompanying drawings and appended claims.

DESCRIPTION OF THE PREFERRED EMBODIMENTS

Figure 1:
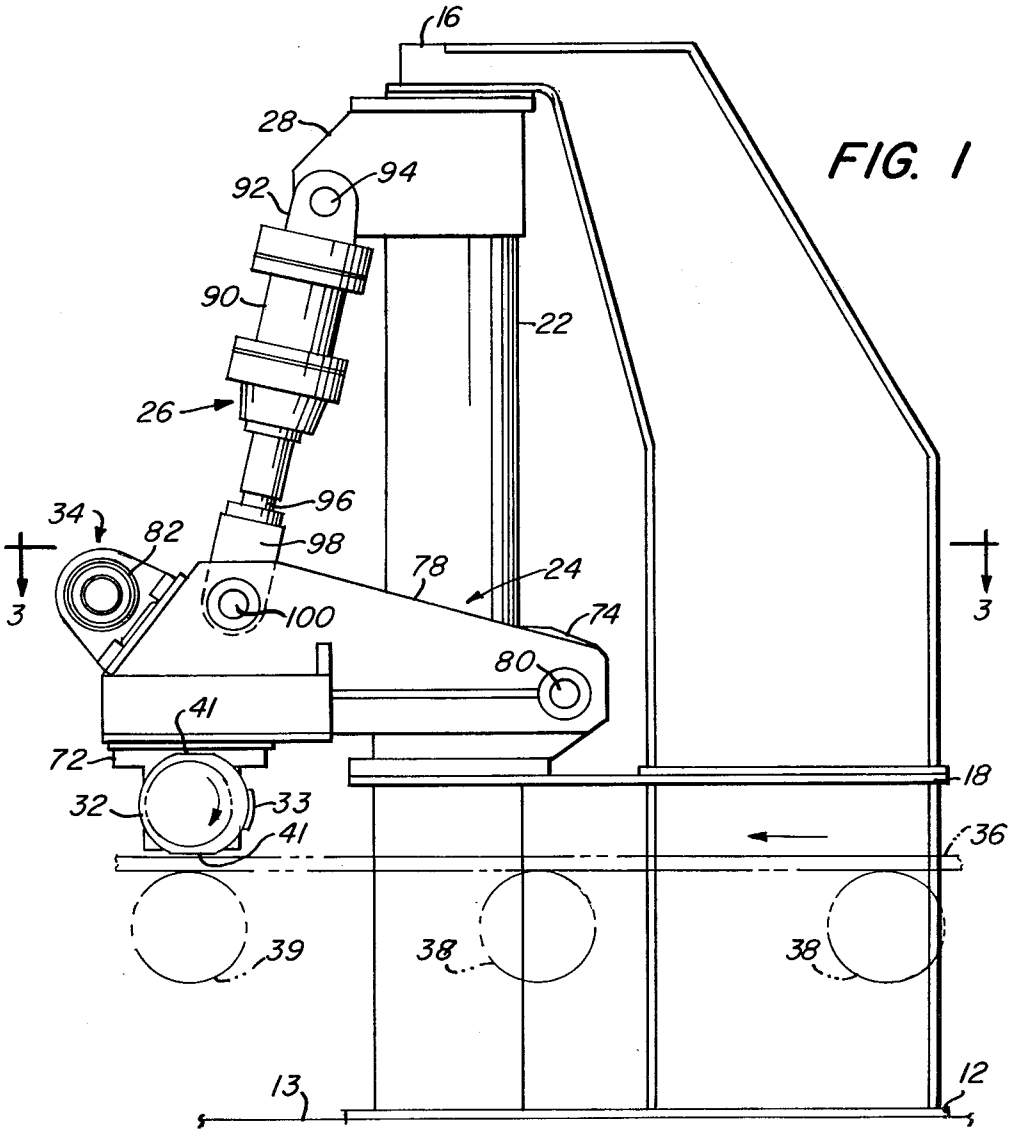
FIG. 1 is a view in side elevation of the plate marking apparatus, illustrating a marking wheel rotatably supported by a carriage mounted on the apparatus above a plate member positioned on rollers for advancing the plate into marking position relative to the marking wheel.
Figure 2:
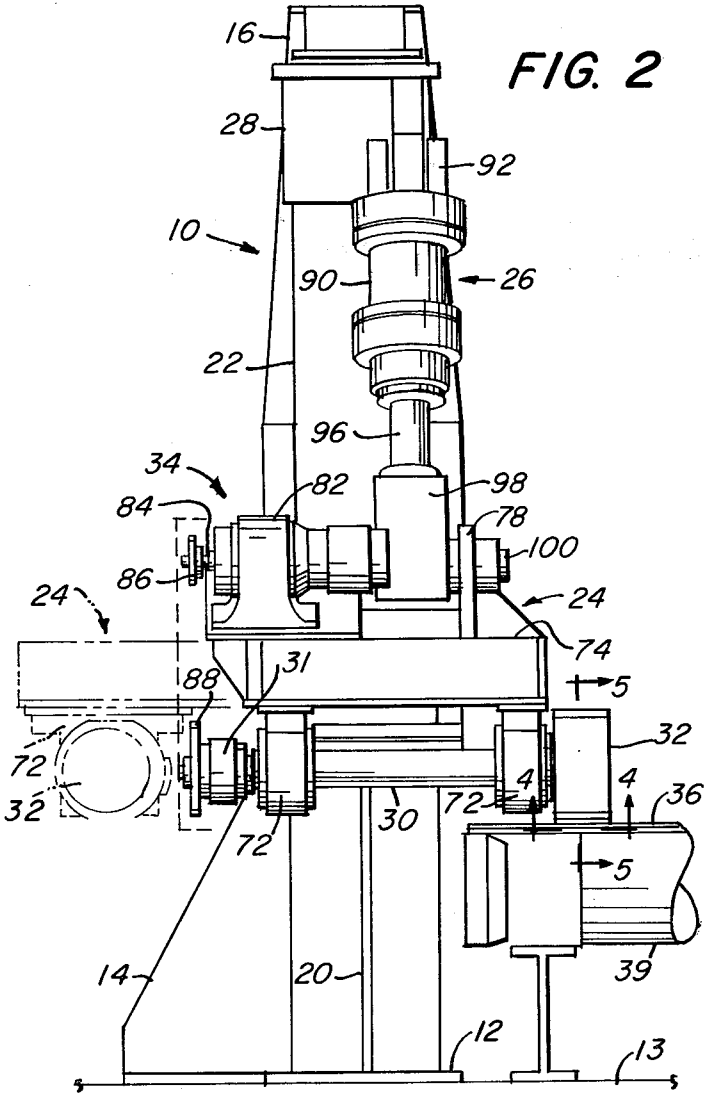
FIG. 2 is a front view of the marking apparatus shown in FIG. 1, illustrating in phantom the position of the marking wheel when the carriage is swung laterally for changing marking elements on the marking wheel.
Figure 3:
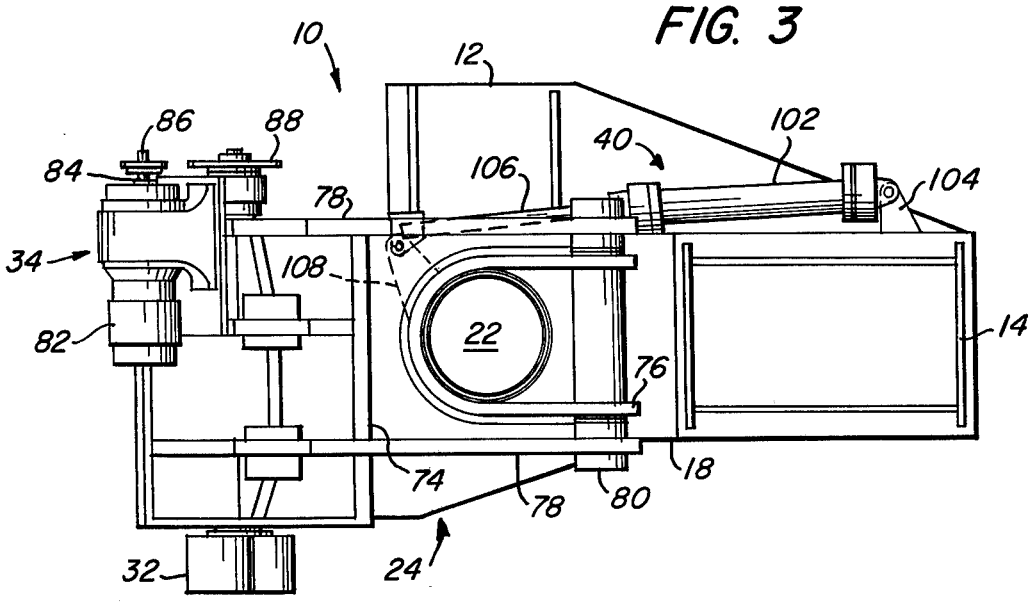
FIG. 3 is a fragmentary top plan view partially in section of the marking apparatus taken along the line 3—3 of FIG. 1, illustrating a piston cylinder assembly mounted on the apparatus frame for laterally pivoting the carriage to move the marking wheel into and out of marking position relative to the plate to be marked.

Referring to the drawings and particularly to FIGS. 1-3, there is illustrated a marking apparatus generally designated by the numeral 10 that includes a base plate 12 horizontally supported on a floor 13 and a frame 14 secured to the base plate 12 and extending vertically therefrom. The frame has an angularly disposed upper end portion 16 that extends outwardly from the frame 14 and in overlying relation with the base plate 12. A horizontal support member 18 is secured to the intermediate portion of the frame 14 and extends forwardly therefrom into underlying relationship with the frame upper end portion 16. The support member 18 is, in turn, supported by a plate member 20 that is secured to and extends upwardly from the base plate 12. With this arrangement, a C-frame is formed by the frame 14, the frame upper end portion 16 and the support plate 18 above the base plate 12. A cylindrical support member 22 is positioned within the C-frame and is secured at one end to the frame upper end portion 16 and at the other end to the support member 18.

A carriage generally designated by the numeral 24 is mounted for vertical reciprocal movement on the cylindrical member 22 by the action of a piston cylinder assembly generally designated by the numeral 26. The piston cylinder assembly 26 is secured at one end portion to a sleeve member 28 that is rigidly mounted on the cylindrical member 22 adjacent the frame upper end portion 16 and at the other end portion to the carriage 24. As illustrated in FIG. 2, a shaft 30 is rotatably supported by the carriage 24 in spaced relation to the cylindrical member 22 and frame 14. The shaft 30 supports a marking wheel 32 having a plurality of marking elements 33 that project beyond the periphery of the surface of the marking wheel 32 as illustrated in FIG. 1. A prime mover, such as an electric motor, generally designated by the numeral 34 is mounted on the carriage 24 and is drivingly connected through a single revolution clutch 31 to the shaft 30. The prime mover 34 rotates the shaft 30 upon actuation of the clutch 31 to rotate the marking wheel 32 through a single revolution and advance the marking elements into marking engagement with the surface of a plate member 36 to be marked to impress a preselected marking arrangement thereon.

The plate member 36 is advanced into marking position with respect to the marking wheel 32 by a plurality of feed rollers 38 and a back-up roller 39 mounted on a roll table that are rotatably and horizontally mounted above the roll table 13. The plate 36 travels on the rollers 38 and 39 as the marking elements of the marking wheel 32 impress the surface of the plate 36. The marking wheel 32 is rotated at a speed not to hinder the movement of the plate 36 and, when desired, to assist in conveying the plate 36 by being rotated at a speed greater than the rate of travel of the plate 36 on the roll table 13. The rollers 38 and 39 are driven (in a manner not shown) to advance the plate 36 horizontally and in underlying relation with the marking wheel 32 so that a mark may be made at selected positions on the surface of the plate 36. The piston cylinder assembly 26 maintains a preselected marking force downwardly upon the carriage 24 to position the marking wheel 32 in marking position relative to the surface of the plate member 36 to provide clearance between the surface of the marking wheel and the surface of the plate, as illustrated in FIGS. 1 and 2.

An exchange of marking elements on the marking wheel 32 is facilitated by a piston cylinder assembly generally designated by the numeral 40 and illustrated in FIG. 3. The assembly 40 is connected at one end to the frame 14 and at the other end to the carriage 24. The piston cylinder assembly 40 is operable upon actuation to laterally pivot carriage 24 on the cylindrical member 22 from the marking position to the changing position illustrated in phantom in FIG. 2. The piston cylinder assembly 26 by exerting a downward marking force on the marking wheel 32 maintains sufficient clearance between the marking wheel and the plate so that the marking wheel may be moved laterally to the changing position without raising the carriage 24 on the shaft 22. With this arrangement the marking wheel 32 may be moved into and out of marking position relative to the plate member 36 to provide access to the marking elements for changing them on the marking wheel 32. Also if desired the entire marking wheel 32 with the marking elements thereon may be easily changed by rotating the carriage 24 to position the marking wheel 32 as illustrated in phantom in FIG. 2.

The marking wheel 32, as illustrated in detail in FIGS. 4–7, has an axial bore 42 extending therethrough with the end of the shaft 30 extending through the bore 42 to position the marking wheel 32 laterally of the carriage 24 and frame 14 in overlying relationship with the plate 36. The marking wheel 32 illustrated in FIG. 5 has a cylindrical surface 43 with a sector 37 of reduced diameter forming planar surfaces 41 on the marking wheel 32. This permits passage of the plate between the back-up roll 39 and surfaces 41 when the marking wheel is in the marking position. The surface 43 of the marking wheel 32 is provided with a plurality of longitudinal recesses 44 for retaining groups of marking elements 45, 46, 47 and 48 on the marking wheel 32.

In a specific embodiment of the present invention marking elements 45 and 46 may indicate the plate specification number, heat number and the company name or code. Similarly marking elements 47 and 48 may represent the plate cut number and the ingot number. Each of the marking elements is retained within a recess 44 by a suitable chase member 49. Each of the chase members 49 is, in turn, locked to the body portion of the marking wheel 32 within a recess 44 by a pin 50 and spacer block 52. With this arrangement the chase members 49 are rigidly secured within the recesses 44.

Figure 7:
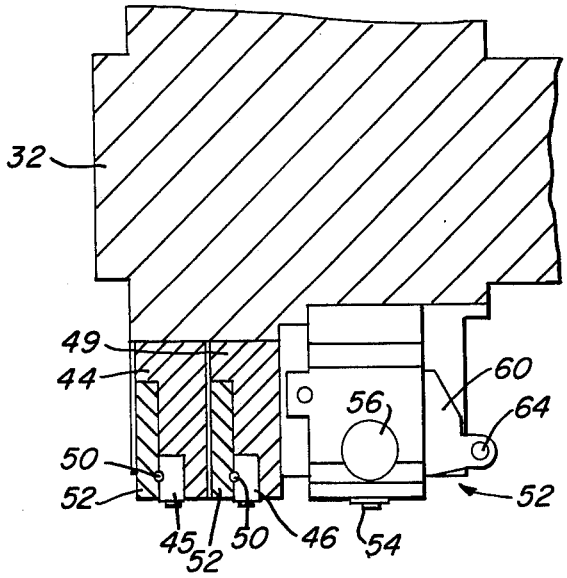
FIG. 7 is a fragmentary view of the marking wheel partially in section taken along the line 7—7 of FIG. 4, illustrating the arrangement of the marking elements retained on the marking wheel.
Figure 5:
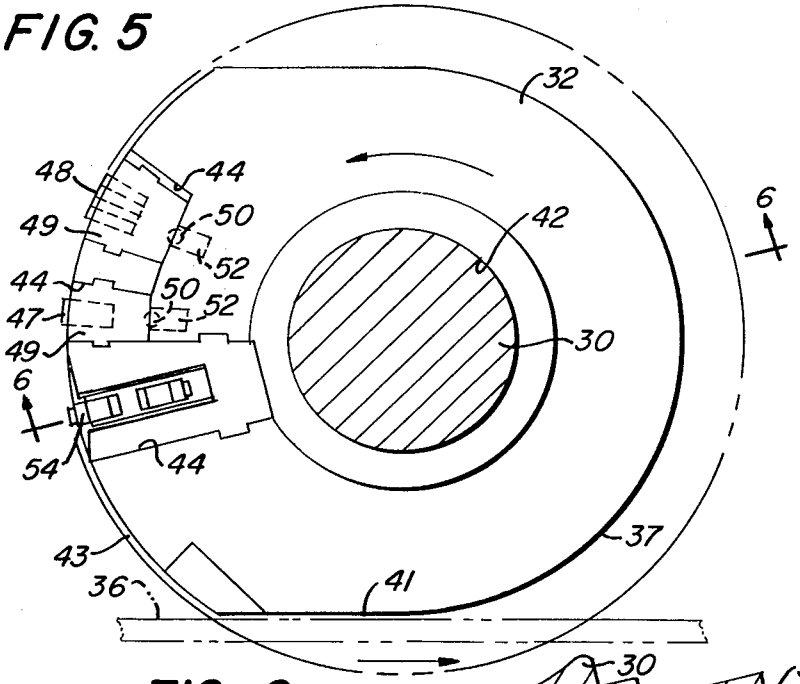
FIG. 5 is a view partially in section of the marking wheel taken along the line 5—5 of FIG. 2, illustrating the configuration of the marking wheel and the marking elements retained within recesses on the marking wheel.
Figure 6:
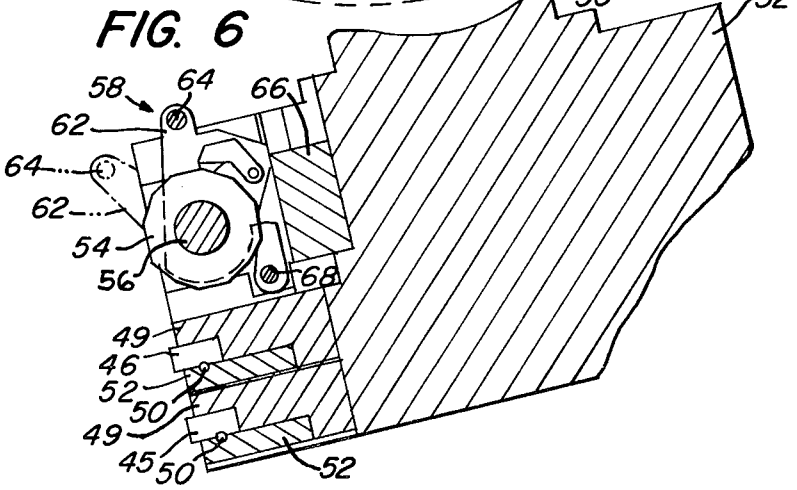
FIG. 6 is a fragmentary sectional view of the marking wheel taken along the line of 6—6 of FIG. 5, illustrating a marking disc rotatably supported in a recess of the marking wheel and arranged to be locked in position for impressing a mark upon the plate.
Figure 4:
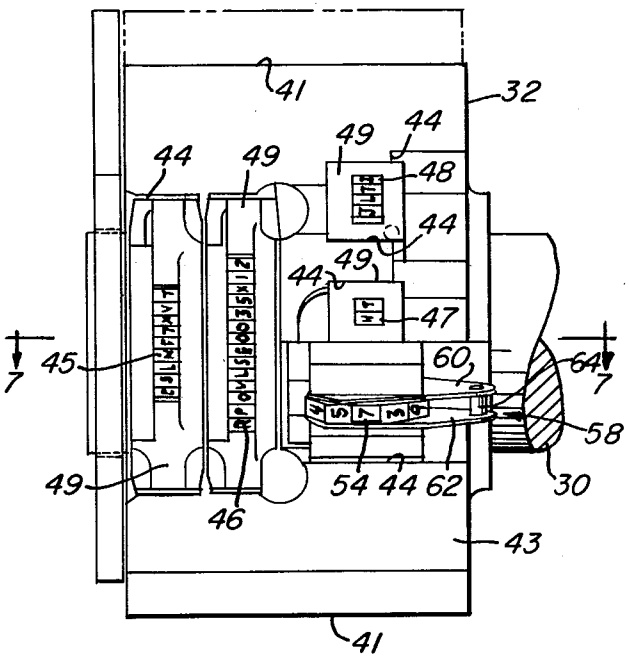
FIG. 4 is an enlarged view of the marking wheel taken along the line 4—4 of FIG. 2, illustrating the marking elements retained on the marking wheel for impressing a preselected mark on the surface of the plate.

The chase members 49 house the marking elements 45, 46, 47 and 48 in a preselected configuration with a preselected type affixed to the end of a marking element as illustrated in FIG. 4. The arrangement of the chase members 49 within the recesses 44 also permits the marking elements to be arranged in a selected pattern for impressing all the marking elements on the surface of plate member 36 upon a single rotation of the marking wheel 32 in a manner hereinafter described. The group of marking elements are interchangeable within the chase members 49. As illustrated in FIGS. 5–7, the chase members 49 retain the marking elements 45, 46, 47 and 48 within the recesses 44 so that the end portions of the marking elements project beyond the periphery of the marking wheel 32 a sufficient distance to provide the desired depth of impression on the surface of the plate 36.

A marking disc 54 having a plurality of type configurations affixed to the peripheral surface thereof for impressing for example a serial number of plate 36 is rotatably supported within a recess 44 by a shaft 56. The shaft 56, is in turn, rotatably supported adjacent the surface of the marking wheel 32 so that the type face on the surface of the marking disc 54 extends beyond the periphery of the marking wheel 32. The marking disc 54 may be retained immovable within the recess 44 to maintain a selected type face in marking position relative to the surface of plate 36 by a trip mechanism 58 illustrated in FIGS. 4, 6 and 7.

The trip mechanism 58 includes a pair of lever arms 60 and 62 that are pivotally mounted on the shaft 56 and secured together by a pin 64. The lever arms 60 and 62 are arranged to pivot on the shaft 56 and engage a stop block 66 that is rigidly retained rearwardly of the disc 54 on the marking wheel 32 as illustrated in FIG. 6. The marking disc 54 is maintained in a selected position on the marking wheel 32 by a pawl 68. The pawl 68 is secured adjacent the lever arms 60 and 62 so as to engage the surface of the marking disc 54 to prevent rotation thereof when the lever arms 60 and 62 abut the stop block 66. By pivoting the lever arms 60 and 62 outwardly away from the stop block 66, as illustrated in phantom in FIG. 6, the pawl 68 is disengaged from contact with the marking disc 54 to permit rotation of the disc on the shaft 56. In this manner, the disc 54 may be rotated to change the serial number on the periphery of the marking wheel 32. In addition, the marking disc 54 may be released from engagement with the shaft 56 to permit exchange of marking discs on the marking wheel 32. Thus, with the above described arrangement a plurality of marking elements having preselected type configurations may be positioned on the marking wheel 32 for impressing a desired stamp or marking pattern on the surface of the plate member 36 as it travels on the rollers 38 and 39 below the marking wheel 32.

The marking elements retained on the marking wheel 32 are rotated into marking position over the surface of the plate 36 by rotation of the shaft 30 generated by the prime mover 34. As illustrated in FIG. 2, the shaft 30 is rotatably supported by bearings 72 that are secured to and extend downwardly from the carriage 24. The carriage 24 includes a frame portion 74 having a yoke 76, illustrated in FIG. 3, that surrounds the cylindrical member 22. A pair of rib members 78 extend upwardly from the carriage frame 74 and are arranged to receive pin 80 that extends through the end portion of the yoke 76. With this arrangement the carriage 24 is slidably mounted for vertical movement on the cylindrical member 22.

The prime mover 34 illustrated in FIGS. 1–3, includes a motor 82 that is mounted on the forward portion of the carriage frame 74. A drive shaft 84 extends outwardly from the motor 82, and a drive sprocket 86 is secured to the drive shaft 84. A driven sprocket 88 is secured to the end portion of the shaft 30 and a suitable drive connection, such as an endless chain or a belt (not shown) connects the drive sprocket 86 to the driven sprocket 88. The driven sprocket 88 is connected to the shaft 30 by the single revolution clutch 31. Preferably the clutch 31 is a conventional roller cam type clutch, such as a Hilliard clutch.

Rotation on the drive shaft 84 generated by the motor 82 is transmitted from the drive sprocket 86 to the driven sprocket 88. Actuation of the clutch 31 transmits rotation to shaft 30. Rotation of the shaft 30, in turn, rotates the marking wheel 32 relative to the surface of the plate 36 to urge the marking elements on wheel 32 into marking engagement with the surface of plate 36. With this arrangement the wheel 32 rotates in a clockwise direction as the rollers 38 and 39 advance the plate 36 beneath the marking wheel. Thus all the marking elements 45, 46, 47, 48 and 54 impress the surface of plate 36 with each rotation of the marking wheel. After each actuation of clutch 31 and single rotation of marking wheel 32, the marking wheel returns to the marking position illustrated in FIG. 1 and maintained by operation of piston cylinder assembly 26.

The marking wheel 32 is maintained in the marking position relative to the surface of the plate 36 by actuation of the piston cylinder assembly 26, illustrated in FIGS. 1 and 2. The piston cylinder assembly 26 includes a cylinder 90 having an end portion with a clevis connection 92 pivotally secured to the sleeve 28 by pin 94. A piston rod 96 extends outwardly from the cylinder 90 and includes a piston rod head 98 that is pivotally connected by pin 100 to the upper portion of the rib members 78. The piston cylinder assembly 26 may be spring actuated or actuated pneumatically or hydraulically by supplying fluid under pressure from a source to the cylinder 90 to extend the piston rod 96 outwardly from the cylinder 90 to maintain a preselected marking force exerted downwardly on the carriage 24 and marking wheel 32. With this arrangement the carriage 24 is positioned on the cylindrical member 22 to in turn position the marking wheel 32 relative to the surface of the plate 36 to permit unobstructed travel of the plate 36 on rollers 38 and 39 beneath the wheel 32. Accordingly, the marking wheel 32 may be raised or lowered by the assembly 26 to compensate for variations in the thickness of plate 36.

The marking wheel 32 impresses the surface of the plate 36 with the desired arrangement as the plate is advanced by the rollers 38. The marking wheel 32 may be selectively rotated by actuation of clutch 31 to impress marks on the plate 36 at any desired location thereon as it advances beneath the marking wheel 32 on the roll table 13. Each actuation of the clutch 31 rotates the shaft 30 and marking wheel 32 such that the marking elements of the marking wheel 32 engage the surface of the plate 36 with sufficient force to indent the plate 36 with the selected impression. Thus, by coordinating actuation of clutch 31 and the rotation of the shaft 30 with the advancement of the plate 36 on the rollers 38 and 39, the marking of the surface of the plate 36 is accomplished.

To exchange the marking elements on the marking wheel 32 or the marking wheel on the shaft 30, the carriage 24 is laterally displaced by the operation of piston cylinder assembly 40, illustrated in FIG. 3. The piston cylinder assembly 40, illustrated in FIG. 3. The piston cylinder assembly 40 moves the marking wheel 32 relative to the plate 36 from the marking position to the changing position. The piston cylinder assembly 40, either pneumatically or hydraulically operated, includes a cylinder 102 having an end portion pivotally connected to a bracket 104 that projects outwardly from frame 14. An extensible piston rod 106 is retained within the cylinder 102 and includes an end portion that is pivotally connected to a bracket 108. The bracket 108 is secured to the yoke 76 of the carriage frame 74. Actuation of the piston cylinder assembly 40 to retract the piston rod 106 within the cylinder 102 laterally swings the carriage 24 and and the marking wheel 32 is a horizontal plane from the marking position to the changing position illustrated in phantom in FIG. 2. In this position the marking elements are readily accessible on the marking wheel 32 for changing.

The marking wheel 32 is swung through an arc of approximately 90° to a position that permits efficient exchange or marking elements on the marking wheel 32 or marking wheels on the shaft 30. Extension of the piston rod 106 from the cylinder 102 swings the carriage 24 in the opposite direction to return the marking wheel 32 to marking position relative to the plate 36. The piston cylinder assembly 40 operates to return the marking wheel 32 to the prescribed location without deviation therefrom. Furthermore, the carriage 24 need not be raised on cylinder 22 to allow swinging movement of the marking wheel 32 relative to the plate 36. Thus, the swinging movement of the carriage 24 about the cylindrical member 22 moves the marking wheel 32 into and out of marking position to permit changes in the mark impressed on the plate 36 without having a realign the marking wheel 32 relative to the plate 36 after each change.

According to the provisions of the patent statues, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

What is claimed is:

1. Apparatus for impressing a preselected mark on the surface of an object to be marked comprising, a frame, a support member secured to said frame, a carriage mounted for vertical and lateral movement on said support member, marking means to impress a preselected mark upon a surface of the object to be marked, said marking means including marking elements, said marking means rotatably supported on said carriage, drive means mounted on said carriage and drivingly connected to said marking means for rotating said marking means through a single revolution to urge said marking elements into marking engagement with the surface of the object to impress preselected marks thereon, a first piston cylinder assembly having a cylinder with an end portion pivotally secured to said support member, said first piston cylinder assembly having an extensible piston rod with an end portion pivotally connected to said carriage so that extension of said piston rod exerts a preselected marking force on said marking means to position and maintain said marking means in marking relation with the object to be marked, a second piston cylinder assembly having a cylinder with an end portion pivotally connected to said frame, and said second piston cylinder assembly having an extensible piston rod with an end portion pivotally connected to said carriage so that actuation of said piston cylinder assembly extends and retracts said piston rod to laterally swing said carriage in a horizontal plane.

2. Apparatus for impressing a preselected mark on the surface of an object to be marked as set forth in claim 1 which includes, said support member including a vertical cylindrical member having upper and lower end portions rigidly secured to said frame, said carriage being pivotally mounted on said cylindrical member for vertical movement relative to the surface of the object to be marked, and said cylinder of said first piston cylinder assembly being pivotally secured at one end portion to said cylindrical member above said carriage.

3. Apparatus for impressing a preselected mark on the surface of an object to be marked as set forth in claim 1 which includes, a roll table positioned beneath said marking means, and said marking means positioned laterally of said support member beneath said carriage and movable with said carriage to position said marking means in marking position spaced above said table and above the surface of the object to be marked so that the object may advance on said table beneath said marking means.

4. Apparatus for impressing a preselected mark on the surface of an object to be marked as set forth in claim 1 in which said drive means includes, a driven shaft secured to said marking means, and clutch means for transmitting rotation to said driven shaft to rotate said marking means through a single revolution.

5. Apparatus for impressing a preselected mark on the surface of an object to be marked as set forth in claim 1 wherein, said second piston cylinder assembly connecting said carriage to said frame is operable upon actuation to swing said marking means laterally about said support member through an angle of about 90° to facilitate change of said marking elements on said marking means.

6. Apparatus for impressing a preselected mark on the surface of an object to be marked as set forth in claim 1 in which said marking means includes, a driven shaft rotatably supported by said carriage, a marking wheel secured to one end of said driven shaft and positioned in overlying relation with the surface of the object to be marked, said marking wheel having a plurality of said marking elements retained in a preselected arrangement on the surface thereof, and said drive means connected to the opposite end portion of said driven shaft to rotate said marking wheel through a single revolution and move said marking elements into marking engagement with the surface of the object to be marked so that each of the marking elements impresses a mark on the surface of the object.

7. Apparatus for impressing a preselected mark on the surface of an object to be marked as set forth in claim 1 in which said marking means includes, a marking wheel rotatably connected to said carriage and having a cylindrical surface with a plurality of recesses selectively positioned on the surface thereof for receiving said marking elements, said cylindrical surface having a sector of reduced diameter forming planar surfaces on said marking wheel to provide clearance between the object and the marking wheel for the unobstructed passage of the object beneath said marking wheel, said marking elements positioned in said recesses, means for retaining said marking elements within said recesses so that the end portions of the marking elements project beyond the periphery of said marking wheel, and said marking wheel being rotatable to advance said marking elements into marking engagement with the surface of the object to be marked to impress a preselected marking arrangement thereon.

8. Apparatus for impressing a preselected mark on the surface of an object to be marked comprising, a frame, a support member secured to said frame, a carriage mounted for vertical and lateral movement on said support member, marking means to impress a preselected mark upon a surface of the object to be marked, said marking means including marking elements, said marking means rotatably supported on said carriage, a prime mover mounted on said carriage, said prime mover having a drive shaft with a drive sprocket secured thereto, a driven shaft rotatably supported by said carriage, said marking means being secured to one end of said driven shaft, a driven sprocket secured to the other end of said driven shaft, means for drivingly connecting said drive sprocket to said driven sprocket, clutch means for engaging and disengaging said driven sprocket to said driven shaft so that rotation of said driven sprocket is transmitted to said driven shaft to rotate said driven shaft through a single revolution and move said marking elements of said marking means into marking engagement with the surface of the object to be marked and thereby impress preselected marks on the surface of the object, and pressure means connected to said carriage for maintaining a preselected marking force upon said marking means.

* * * * *